United States Patent [19]

Mendenhall

[11] 4,126,397

[45] Nov. 21, 1978

[54] ASPHALTIC CONCRETE RECYCLE APPARATUS

[76] Inventor: Robert L. Mendenhall, 1770 Industrial Rd., Las Vegas, Nev. 89102

[21] Appl. No.: 754,313

[22] Filed: Dec. 27, 1976

[51] Int. Cl.[2] ..... B28C 5/46

[52] U.S. Cl. ..... 366/7; 366/25; 366/33

[58] Field of Search ..... 259/146, 147, 148, 155, 259/156, 157, 158, 159 R, 159 A, 3, 2, 14, 165; 106/273 R, 276, 277, 285; 404/79; 366/25, 33, 7

[56] References Cited

U.S. PATENT DOCUMENTS

| | | | |
|---|---|---|---|
| 3,667,736 | 6/1972 | Carroll | 259/165 |
| 3,845,941 | 11/1974 | Mendenhall | 259/157 |
| 3,999,743 | 12/1976 | Mendenhall | 259/158 |

*Primary Examiner*—Robert W. Jenkins
*Attorney, Agent, or Firm*—Seiler & Quirk

[57] ABSTRACT

In an apparatus for heating and mixing asphalt-aggregate composition in a rotating cylindrical drum by contact with a plurality of elongated heating tubes extending along the drum interior, the improvement comprises introducing coarse particles of the composition at a relatively cool end or area in the drum and introducing smaller sized composition particles in a relatively warmer area of the drum.

8 Claims, 1 Drawing Figure

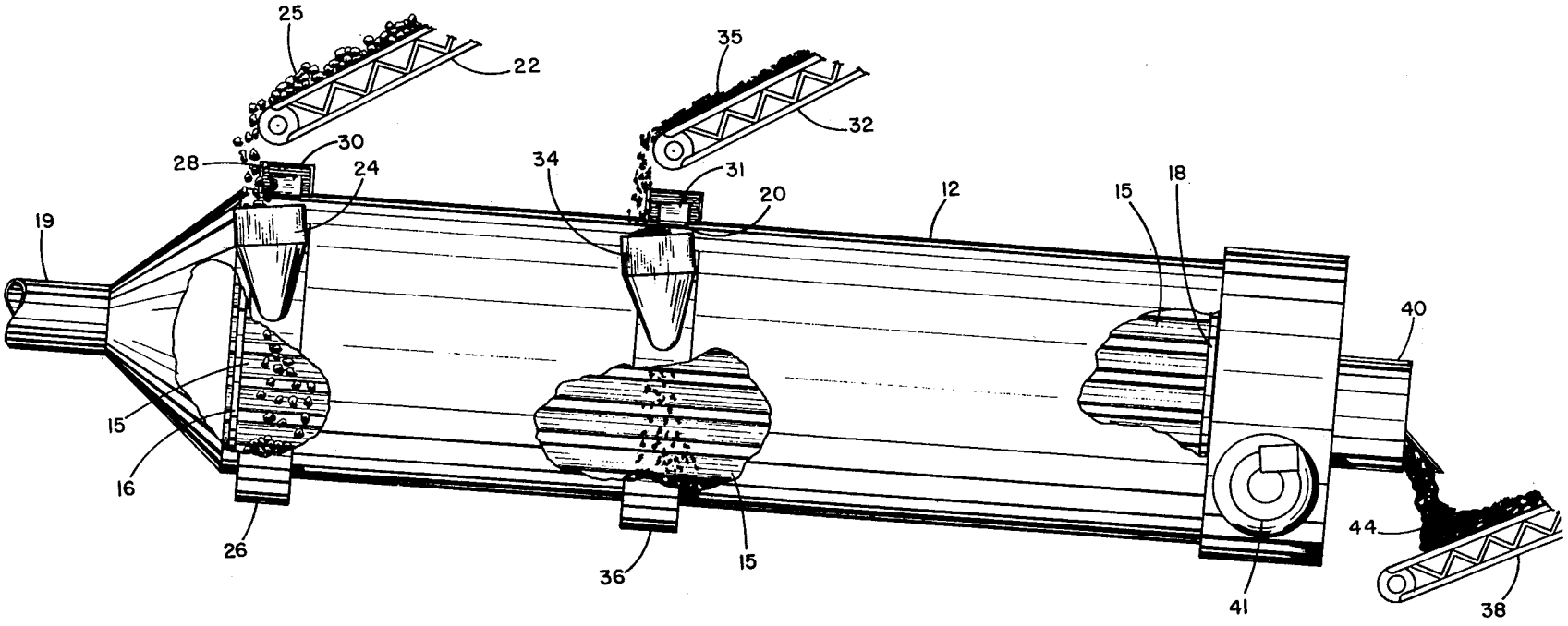
38
40
44
41
18
15
12
32
20
35
31
15
36
34
22
24
30
25
26
28
16
15
19

ASPHALTIC CONCRETE RECYCLE APPARATUS

BACKGROUND OF THE INVENTION

In my prior U.S. Pat. Nos. 3,845,941, 3,971,666, and 3,915,002 there are disclosed methods and apparatus for recycling asphalt-aggregate composition utilizing an elongated cylindrical drum in which the composition is heated and mixed as drum is rotated. The apparatus has a combustion chamber adjacent the drum output end, and hot gases of combustion are directed into the elongated tubes which gases are then exhausted at the opposite tube end at or adjacent the input apparatus end. The asphalt-aggregate composition to be recycled, after it has been crushed and screened is introduced into the drum at the input end, which is the cooler end of the apparatus. The drum is tilted with the input end being elevated from the output end so that the composition is drawn gravitationally to the output drum end, where it is recovered.

Heretofore, it has been the practice to introduce all of the composition particles into the apparatus at the input end, normally through a hopper, or the like, whereby all of the composition particles then pass substantially the entire drum length between the input and output drum ends as they become gradually heated and mixed. One problem with utilizing such a method in which particles of all size ranges obtained from the crushing and screening of the used asphaltic concrete material are introduced together at the drum input end is that the smaller particles often become overheated or the larger particles are not heated enough. The smaller particles traveling substantially the entire drum length and because of the relatively greater surface area and concomitantly greatest surface exposure to the heated tube surfaces may be overheated, whereas the larger composition particles, do not become so readily heated because of their greater mass:surface ratio. Due to the significant difference in heating rates of larger and smaller composition particles, in order to adequately bring the coarse particle heat temperatures up to the final desired composition temperatures, for example, of between about 200° and 300° F., increased residence times or increased apparatus heating, or both, for the compositions have been required. This is normally achieved by decreasing the tilt of the drum, or lowering its angle relative to horizontal, which has resulted in greater amounts and weight of composition being treated in the apparatus at any given moment. This increased weight significantly increases power requirements in rotating the large drum, which may weigh 60 tons empty, and generally puts a greater overall strain on the equipment as compared to that where composition weight in the apparatus is lower. Moreover, with the larger volumes of material being mixed in the apparatus, mixing is more difficult and less efficient. In addition, when the small particles become overheated, there results volatilization of hydrocarbon in the asphalt, as well as melting and sticking of the smaller particles to the heating tubes, which composition then builds up on the tubes, and further reduces heating efficiency of the apparatus. It is to the elimination of these problems that the present invention is directed.

SUMMARY OF THE INVENTION

The present invention is directed to an apparatus of the type above described. The apparatus includes means for introducing coarse asphalt-aggregate composition at an input drum end and an opposite output end for product recovery whereby the coarse particles will be required to travel substantially the entire length of the heating and mixing drum during the process. Smaller sized particles are introduced into the drum at a location intermediate the input and output drum ends, whereby these particles will be required to travel only a portion of the total drum length during the processing. The advantages of using such an apparatus and the resulting improved process yields shorter small particle residence times thereby avoiding their overheating, reduces sticking and build up of small particles on the heating tubes, allows the angle of the tilted drum to be increased thereby increasing throughput rates, and decreasing composition weights required in the process at any given time to improve mixing efficiency and reduce apparatus wear and strain. At the same time, the coarse or larger size particles which are slower to heat than the smaller particles, are exposed to the heating tubes for longer periods of time in the absence of the smaller particles during a portion of the composition residence. These as well as other advantages will be evident from the following description.

BRIEF DESCRIPTION OF THE DRAWING

The drawing shows an elongated cylindrical drum of the invention, partially cut away to expose the interior thereof, and showing the improved means for introducing coarse particles and small particles, respectively.

DETAILED DESCRIPTION OF THE INVENTION

Observing now the drawing, there is illustrated an improved apparatus of the present invention comprising an elongated cylindrical and rotatable drum 12. A portion of the drum wall has been cut away in order to observe a plurality of elongated pipes 15 which extend substantially the entire length of the interior of the cylindrical drum. The pipes extend through a forward end wall 18 and a rearward end wall 16, so that the hollow interior of the pipes communicates exteriorly of these respective end walls. Forwardly of the forward end wall 18 is a combustion or firing chamber 42 into which a burner 41 supplies a flame. This flame, and the resulting hot gases of combustion are directed into the forward ends of the hollow pipes. The hot gases are drawn through the pipes and are exhausted through an exhaust member 19, which cooperates with an exhaust fan for drawing the hot gases of combustion from the forward drum end to the rearward end which are hereinafter referred to as output end and input end, respectively. Asphalt-aggregate composition is mixed within the interior drum mixing chamber as the drum rotates with the composition cascading over the heated pipes where it thus becomes heated. Moreover, the composition is drawn gravitationally from the input end of the apparatus which is elevated above to the output drum end where it is recovered. Heated and mixed composition is then recovered via chute 40 which composition 44 is illustrated as being removed via the conveyor 38 or similar means. Since the elongated pipes 15 extend through the forward end wall 18 and communicate with the firing chamber 42, the interior of the apparatus is not exposed directly to the hot gases of combustion. Additional details of the apparatus of this type is fully explained in my aforesaid patents, which description is incorporated herein by reference.

The improvement of the invention comprises means for introducing composition into the drum at different locations. It will be understood that since the hot gases of combustion first enter the forward end of the pipes, which extend through forward end wall 18, and which hot gases of combustion travel the entire length of the pipes and are exhausted at the rearward pipe ends which extend through rear end plate 16, the input apparatus end will be somewhat cooler than the output end. As composition is drawn gravitationally from the input drum end toward the output end, it becomes gradually heated, because of its continued exposure to the heated pipes. The apparatus of the invention includes a first means for introducing the coarse composition particles comprising a chute or hopper 24 into which the coarse particles 25 are directed from a conveyor 22. This chute communicates with the interior of the drum. The chute is adjacent rear end wall 16 of the apparatus so that the coarse composition particles must travel substantially the entire apparatus length from the input end to the output end for recovery.

Since, according to the invention, it has been found advantageous to introduce smaller particles intermediate the input and output drum ends, for this purpose a chute 34 is located along the drum as shown. This chute or hopper also communicates with the interior of the drum so that smaller composition particles 35 introduced therein fall gravitationally into the drum at that position and travels a shorter distance to the output end than the coarse particles. Since the smaller composition particles become heated more rapidly than larger or more coarse particles, they will become heated to the desired temperature during the shorter heating time and distance and without becoming overheated.

Any suitable means for introducing the composition may be used, the preferred embodiment incorporating a scoop means secured to the drum exterior and cooperating with a trough into which composition is placed as is illustrated in FIG. 1. For example, at the input end of the apparatus, a trough 26 is stationarily positioned around the cylindrical drum 12 adjacent end wall 16. A plurality of spaced ports 30 are located around the drum surface which ports opens into the drum interior and communicate with the trough interior. A scoop 28 is secured to the drum exterior overlying each port 30. Trough 26 extends around the drum covering the scoops and forming a cavity in which the scoops are disposed and pass as the drum rotates. Chute 24 communicates with the trough so that composition particles introduced through the chute and into the trough are then picked up by the scoops and fall gravitationally through ports 30 and into the drum interior. The size and shape of the trough should be such as to allow the scoop to pass and to pick up the composition introduced into the trough cavity. The trough sides preferably have edges which follow the general shape of the drum exterior around which they extend but which side edges are spaced at least slightly from the drum surface to avoid contact since the drum rotates while the trough is maintained in a stationary position. The size and shape of the scoops and trough are not particularly critical but are preferably such that the outer scoop edge is of the same shape but slightly smaller that the interior trough wall. Moreover, the scoops may be sloped so that the composition will fall easily along the scoop interior and into the ports gravitationally.

Spaced forwardly from chute 24 is chute 34 which is secured to stationary trough 36. A plurality of ports 20 extend around the drum wall, and scoops 31 rotate as the drum rotates to pick up composition and introduce it into the drum cavity substantially as previously described. Conveyor 32 conveniently brings smaller composition particles 35 and allows them to be dropped into chute 34. Any further specific details of the scoops, ports and troughs may be found in applicant's co-pending applications Ser. No. 601,177 filed Aug. 1, 1975 which description is incorporated herein by reference.

Although only two positions for introducing coarse and smaller particles respectively are illustrated in the drawing, it should be understood that more than two may be used. For example, a third position for introducing even smaller composition particles may be placed forwardly of chute 34, i.e., between that position and the output drum end where even less heating and mixing exposure is desired because of the fine particle size. Accordingly, any number of positions and means for introducing composition particles of different size ranges, may be used, the larger size particle sizes being introduced nearer the cool apparatus end for longer heating times and the finer particles nearer the hot apparatus end may be used as described.

An important feature of the invention is separating the crushed asphalt-aggregate composition into particle size portions of coarse and fine, where two particle size ranges are to be used and these particle sizes introduced into the apparatus illustrated in the drawing in the two drum areas. On the other hand, for some operations, it may be desirable to separate the particles into three size ranges, and the apparatus modified so as to allow introduction of three particles sizes in three different zones in the apparatus with the coarse particles introduced nearest the input drum end, intermediate particles nearer the output drum end, and fine particles nearer yet to the output drum end. Sizing and separation of the particles of the composition to be recycled is described in my prior U.S. Pat. No. 3,999,743, and co-pending application Ser. No. 729,705, filed Oct. 5, 1976 the descriptions of which are incorporated herein by reference.

For most operations, separation of particles into two size ranges will be preferred. Conveniently, coarse particles may be those retained by a No. 4 U.S. Series sieve while fine particles are those which will pass a No. 4 sieve. Normally, for most recycled compositions, coarse particles as so defined herein, comprise between about 35 and about 75% by weight, with fine particles, of course, making up the remainder of the composition. Moreover, a No. 4 sieve separation point may not be desirable for all recycled compositions, and depending upon the specific recycled material, and the gradation of the particle sizes, the separation point may be varied as desired. For example, a ¼ inch and larger coarse particle size definition may be used instead. It should also be understood that although portions of particle size ranges are described as those retained or passing certain sieve sizes, in any given portion, there will be some particles outside of that range present, simply because separation techniques are not absolutely precise. However, some overlap or presence of particle sizes outside of a given or stated range is generally acceptable.

Where separation into three particle sizes is desired, coarse particles may be conveniently defined as those which will be retained by a ⅛ inch sieve, fine particles as those passing a No. 8 U.S. Series sieve, and intermediate particles being those passing ⅛ inch sieve but retained by the No. 8 sieve. Utilizing such a separation, normally particles will comprise between about 10 and about 55%, and preferably between about 15 and about 40%, by way of the total composition, intermediate particles between about 15 and about 60% and preferably between about 25 and 45%, and fine particles between about 20 and about 60%, and preferably between about 30 and about 50% by weight. Although these particle size ranges and proportions are generally applicable to most recycled composition, they are given by way of illustration only and the invention is not to be so limited. For example, instead of the aforesaid particle size portions, it may be desirable to define coarse particles as those retained by a No. 4 U.S. Series sieve, intermediate particles passing a No. 4 sieve but retained by a No. 20 sieve, and fine particles as those passing a No. 20 sieve. Accordingly, different particle size ranges are set forth by way of conveniently illustrating suitable particle sizes for most recycle compositions, but depending on the specific type of asphaltic concrete being recycled, as well as its condition, crushing apparatus used, and lay down product specifications, variations may be used.

Normally, the particle sizes of recycled compositions from torn up pavements which are then crushed, will range from those passing a No. 200 Series sieve up to 1 inch. However, usually particles greater than 1 inch in diameter may be again crushed to further reduce the particle size. For most recycled asphalt-aggregate compositions specification, up to about 10% of the particles may be retained by a ¾ inch sieve at the coarse end while up to about 10% pass a No. 200 U.S. Series sieve at the fine or small particle end. For most specifications, about 80% or more of particles to be used in a recycled process according to the invention will be between ¾ inch and a No. 20 U.S. Series sieve.

Once the respective particle portions have been introduced in the apparatus in the separate zones, and have been thoroughly mixed and heated to the desired temperatures, they are recovered at the drum output end via chute 40. A softening agent, and/or make-up asphalt may be added in the mixing and heating apparatus illustrated, or they may be mixed with the composition in a separate mixing apparatus such as a pug-mill or the like. The addition of a softening agent, preferably an aromatic hydrocarbon having at least 55% aromatic content is used to achieve a final composition having the desired properties. Such an aromatic hydrocarbon is fully described in my U.S. patent 4,000,000, and which description is incorporated herein by reference. In addition, the used composition being recycled is usually detected for any asphalt deficiency, and make-up asphalt added in order to meet final desired or required product specifications.

Again, since coarse particles are preferably introduced at the input end of the apparatus opposite the output or product recovery end in order to achieve maximum heating residence time in the apparatus, the chute or other means for introducing the coarse particles is preferably located at or adjacent the input apparatus end. However, the chute or other introducing means may be located somewhat forwardly from that position, as desired, if maximum coarse particle residence is not desired. As for the one or more intermediate zones for introducing the smaller particles, depending on whether they are divided into two or more particle size ranges, these input ports and chutes may be placed in any desired location so as to expose the particles so introduced at those locations to the desired heating times within the apparatus in order to maximize heating and mixing efficiency, without overheating the smaller size particles for the reasons set forth hereinabove. Thus, the smaller the particle size range being introduced, the closer it may be introduced to the output drum end. These as well as other modifications of the apparatus and the advantages thereof within the purview of the invention will be evident to those skilled in the art.

I claim:

1. In an apparatus for recycling asphalt-aggregate composition comprising an elongated rotatable cylindrical drum having a plurality of heating tubes extending along the length of the drum interior, means for heating said tubes, and means for recovering composition from one end of said drum, the improvement comprising:

first means for introducing particles of said composition adjacent an end of said drum opposite the product recovery end, and second means for introducing particles of said composition intermediate said drum ends comprising a port on the drum and communicating interiorly of said drum.

2. An apparatus for heating and mixing asphalt-aggregate compositions comprising:

an elongated rotatable cylindrical drum having a plurality of heating tubes extending along the length of the drum interior, means adjacent a first end of said drum for heating said tubes whereby said tubes are hottest at said first drum end, first means for introducing particles of said composition adjacent a second end of said drum opposite said first end, and second means for introducing particles of said composition intermediate said first and second drum ends comprising one or more ports communicating interiorly of said drum.

3. Apparatus of claim 2 wherein at least one of said introducing means comprises a plurality of scoops spaced around said drum, a port communicating with each scoop and interiorly of said drum, and a stationary trough extending around at least the lower portion of said drum for receiving said composition and said scoops as said drum is rotated.

4. Apparatus of claim 2 wherein said heating means comprises a combustion chamber and a burner for introducing hot gas into said tubes at said output drum end.

5. In a process for heating and mixing particles of asphalt-aggregate composition in a rotating drum by exposing said particles to heated pipes extending along the drum interior while gradually drawing the composition from a drum input end to an output end, the improvement comprising introducing coarse particles of said composition adjacent said drum input end, and introducing smaller sized particles intermediate said drum input end and said output end.

6. In a process for heating and mixing asphalt-aggregate composition wherein said composition is drawn from a relatively cool input end of a rotating drum to a hotter output end thereof while exposed to heated tubes and wherein hot gases of combustion are directed into said tubes adjacent the drum input end and exhausted from said tubes adjacent the drum output end, whereby said tubes become cooled between the input end and the output end, the improvement comprising introducing coarse composition particles into the drum in a relatively cooler tube zone and introducing smaller particles into the drum in a relatively hotter tube zone.

7. The process of claim 6 wherein the coarse particles are introduced adjacent said input drum end and the smaller particles are introduced intermediate said drum input end and output end.

8. The process of claim 7 including separating the composition into coarse, intermediate and fine particle size ranges, and introducing intermediate sized particles into said drum nearer the output drum end than the coarse particles, and introducing fine particles nearer the output drum end than the intermediate particles.

* * * * *